US005547003A

United States Patent [19]

Susnjara et al.

[11] Patent Number: 5,547,003

[45] Date of Patent: Aug. 20, 1996

[54] DEVICE AND METHOD FOR FORMING SQUARE INSIDE CORNERS ON RAISED PANELS FORMED OF SINGLE WORKPIECES

[75] Inventors: Kenneth J. Susnjara, Santa Claus; Michael P. Hardesty, Dale, both of Ind.

[73] Assignee: Thermwood Corporation, Dale, Ind.

[21] Appl. No.: 241,191

[22] Filed: May 11, 1994

[51] Int. Cl.[6] ..... B27M 1/08

[52] U.S. Cl. ..... 144/368; 83/613; 29/558; 144/367; 144/371; 144/147; 144/24.02

[58] Field of Search ..... 29/558; 144/1 R, 144/3 R, 134 R, 146, 147, 367, 368, 369, 371, 329; 83/581, 613; 74/25, 27, 39, 49, 50, 55, 56

[56] References Cited

U.S. PATENT DOCUMENTS 4,932,450 6/1990 Baker ..... 144/147

*Primary Examiner*—W. Donald Bray

*Attorney, Agent, or Firm*—Lalos & Keegan

[57] ABSTRACT

Square inside corners are formed in raised panels from a single workpiece to be used in the manufacture of cabinetry, furniture and the like. A machine with a rotatable spindle provides the drive for the square corner forming tool bit. The tool bit is mounted on a support that translates the rotary motion of the spindle to a reciprocating motion of the tool bit. The tool bit has a pair of side wall surfaces that are displaced at an angle equal to one half the angle formed by the corner, relative to the line of travel of the tool bit. The lower edges of the side wall surfaces are formed with cutting blades, ridges, or abrasive surfaces or, alternatively, the bottom wall surface of the tool bit is formed with such cutting edges.

16 Claims, 3 Drawing Sheets

DEVICE AND METHOD FOR FORMING SQUARE INSIDE CORNERS ON RAISED PANELS FORMED OF SINGLE WORKPIECES

FIELD OF THE INVENTION

This invention relates to raised panels used in the manufacture of cabinetry, furniture and the like, and more particularly to a device and method for forming square inside corners in raised panels from a single workpiece.

BACKGROUND OF THE INVENTION

In the prior art, it has been the conventional practice to manufacture raised panel door fronts, drawer fronts and similar components in the manufacture of cabinetry and furniture by forming a rectangular centerpiece with relieved side portions, forming four framed pieces having relieved inner edge portions provided with centerpiece receiving grooves, and mitered ends and assembling and securing such pieces together to provide a raised panel member. Such method of manufacture, however, has many disadvantages. It is expensive because it requires several parts that must be machined precisely and assembled together involving a number of machining and manual assembly operations. In addition, raised panels manufactured in such manner have a tendency to separate as a result of changes in climatic conditions.

In order to reduce costs in the manufacture of such panels, it further has become the practice in the prior art to form such panels by machining recesses in panels formed of single sheets of material such as particle board and medium density fiber board using router bits. Such improved method, however, normally results in the production of rounded corners in the panel due to the rotary motion of the routing bit. In order to simulate a conventional raised panel article, material in the round corners must be removed to provide a square corner. In the prior art, it has been the practice to either manually or mechanically chisel such material out. Such method, however, has been found to be unsatisfactory in that to perform it manually increases the cost of the product and chiseling it mechanically results in large cutting forces making such a process difficult to adapt to a computer controlled machine tool. It thus has been found to be desirable to provide an improved method for contouring a curved inside corner of a raised panel mechanically without requiring large cutting forces for the cutting tool.

Accordingly, it is the principal object of the present invention to provide a device for cutting a rounded inside corner of a raised panel member to provide a square corner.

Another object of the present invention is to provide a novel device for cutting a rounded inside corner of a workpiece to form a square corner which requires comparatively less cutting forces than conventional chiseling devices.

A further object of the present invention is to provide a novel device for cutting square corners in curved inside corners of workpieces which is adapted to be used on computer controlled machine tools.

Another object of the present invention is to provide a novel device for cutting a curved inside corner of a workpiece to form a square corner which is operable to form corner profiles of different configurations.

A further object of the present invention is to provide a novel device mountable on a computer controlled machine tool provided with a routing tool whereby the machine tool can be operated to route a groove having rounded corners in the workpiece and then sequentially apply such device to form square corners from such rounded corners.

A still further object of the present invention is to provide a device mountable on a machine tool for forming a corner having angularly displaced surfaces from a curved inside corner of a workpiece.

Another object of the present invention is to provide a device for cutting a curved inside corner in a workpiece to form a square inside corner which is simple in design, inexpensive to manufacture and highly effective in performance.

A still further object of the present invention is to provide a novel method of cutting a curved inside corner of a workpiece to form a square inside corner.

Other objects and advantages of the present invention will become more apparent to those persons having ordinary skill in the art to which the present invention relates from the following description taken in conjunction with the accompanying drawings wherein:

DETAILED DESCRIPTION

Figure 1:
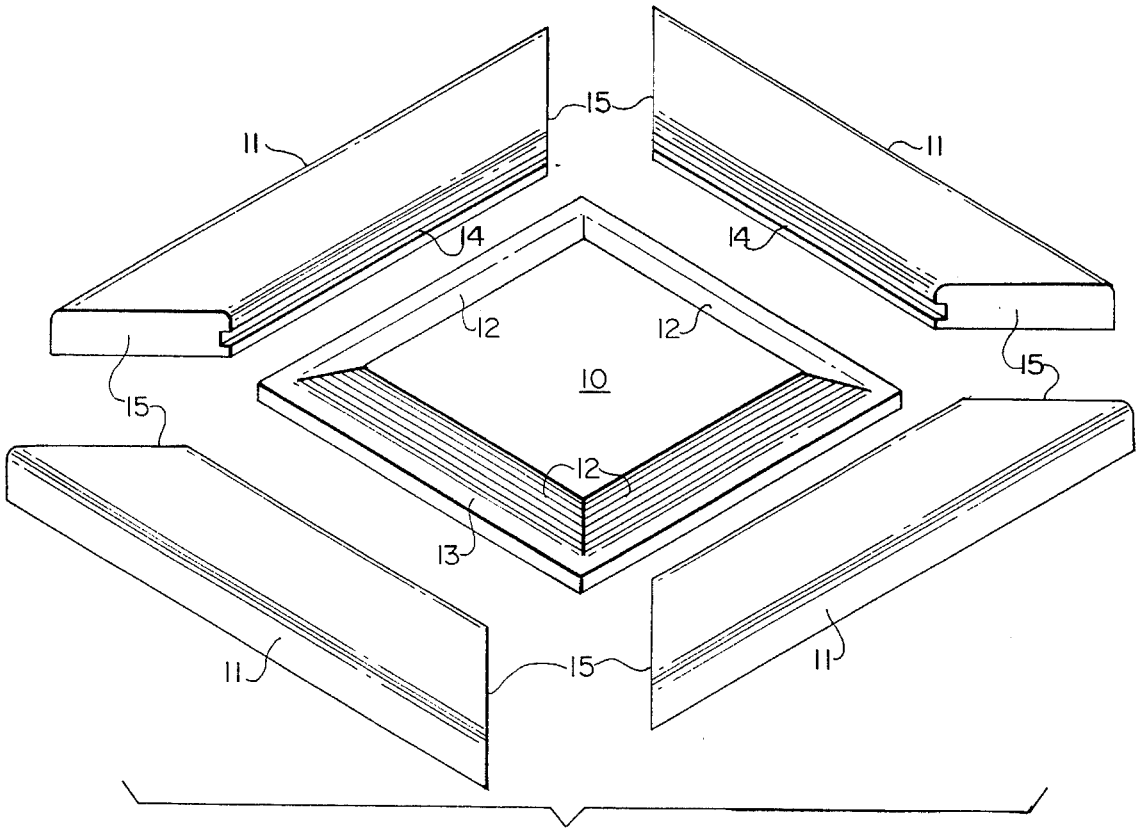
FIG. 1 PRIOR ART
FIG. 1 illustrates a prior art raised panel article having the components thereof disposed in exploded relation.

Referring to FIG. 1, there is illustrated the components of a conventional raised panel member which includes a rectangular, centerpiece 10 and four frame pieces 11. The centerpiece is formed with relieved side portions 12 providing a laterally projecting, peripheral portion 13 adapted to be received in grooves 14 provided along the inner sides of the frame pieces. In the conventional manufacture of panels utilizing the components shown in FIG. 1, the centerpiece must be machined to provide the relieved side portions and the peripheral lip portion. The frame pieces must be machined to form the grooves 14 and the mitered end surfaces 15 and glue must be applied to the various mating surfaces and the several pieces must be fitted together and clamped tightly to produce the raised panel article. Such process is not only time consuming but costly.

Figure 2:
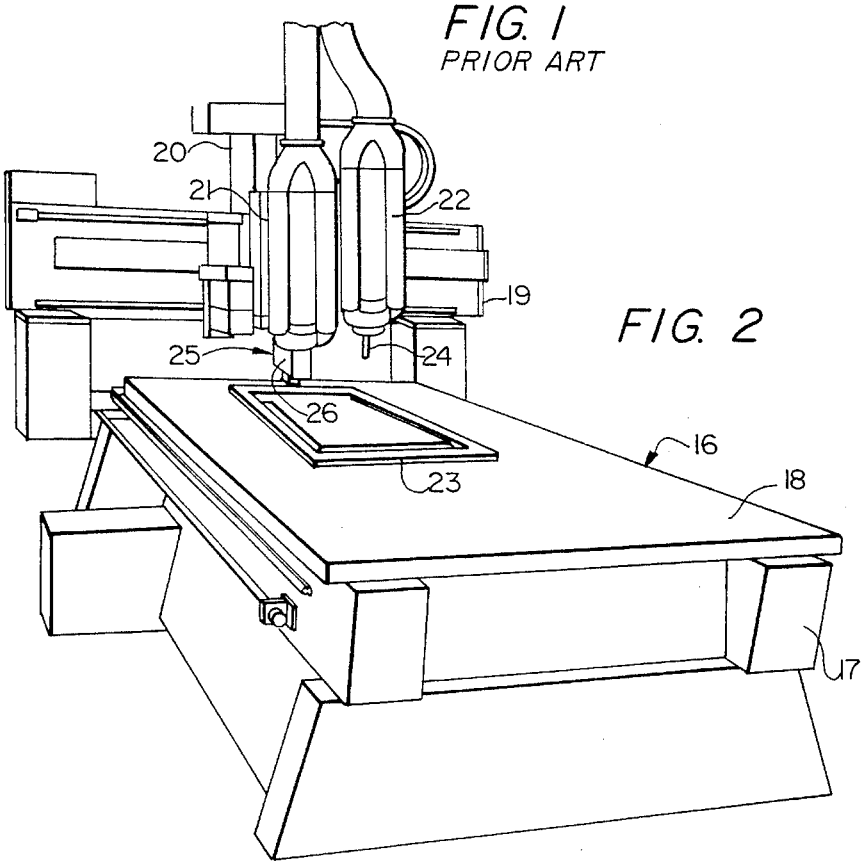
FIG. 2 is a perspective view of a computer controlled machine tool on which an embodiment of the present invention may be mounted to remove material from a rounded inside corner of a workpiece to form a square corner.

In the novel method of the present invention, a raised panel member is formed with a computer controlled machine 16 as shown in FIG. 2 utilizing first a routing operation and then a square corner forming operation. The machine tool is of a type manufactured and sold by the Thermwood Corporation of Dale, Ind. which generally includes a base member 17, a stationary table 18 mounted on the base member, a gantry 19 mounted on the base member and displaceable longitudinally or along an x-axis, a tool head support frame 20 mounted on the gantry and displaceable transversely or on a y-axis and a set of tool heads 21 and 22 mounted on the support frame and displaceable vertically about a z-axis. The motions of the gantry, support frame and tool heads are controlled by a programmable controller in the conventional manner to position and advance the various tool bits to perform various work functions on a workpiece 23 mounted on the table. In FIG. 2, tool head 22 is provided with a router bit 24 and tool head 21 is provided with a square hole forming device 25.

Figure 4:
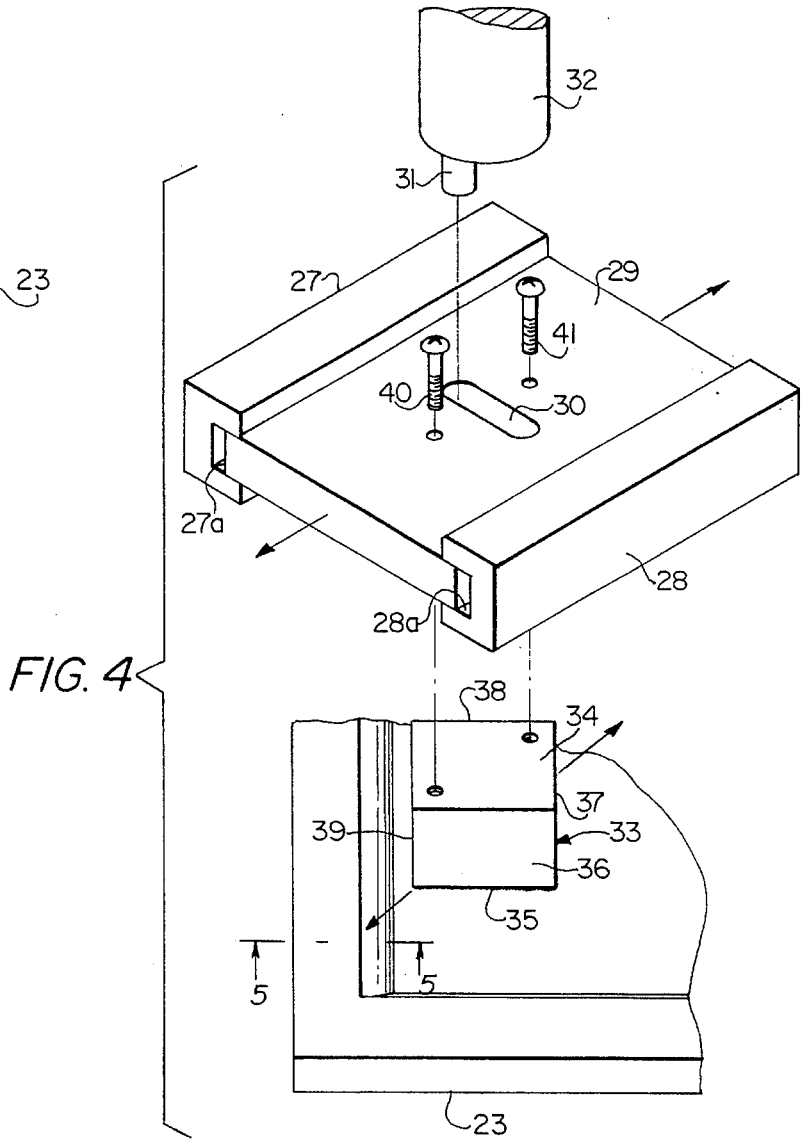
FIG. 4 is an enlarged perspective view of the device shown mounted on the machine tool in FIG. 2, having portions thereof disposed in exploded relation and in relation to a workpiece.

As best seen in FIGS. 2 and 4, device 25 is provided with a housing 26 which is adapted to be detachably mounted on the lower end of tool head 21. Disposed on the housing is a pair of transversely spaced guide members 27 and 28 provided with a pair of opposed, parallel guide channels 27*a* and 28*a*. Received within the guide channels is a longitudinally reciprocal plate member 29 provided with a transversely disposed slot 30 in the center thereof. The slot is adapted to receive a pin 31 of a spindle 32 of tool head 21 or an adapter mountable on the lower end of the spindle of tool head 21, which is displaced radially or eccentrically relative to the vertical axis of the spindle of tool head 21. It will be appreciated that upon rotation of spindle 32 the engagement of eccentric pin 31 with the front and rear walls of slot 30 will cause the rotational motion of the spindle to be translated to reciprocating motion of plate member 29.

Mounted on the underside of plate member 29 is a tool bit 33. The tool bit has a square shaped configuration including an upper surface or wall 34 engaging the underside of plate member 29, a bottom surface or wall 35 and four side surfaces or walls 36, 37, 38 and 39. The tool bit is secured to plate member 29 by means of a set of bolts 40 and 41 which extend through longitudinally aligned openings in the plate member and are threaded into threaded holes provided in the top surface of the tool bit. The tool bit is positioned relative to the plate member so that leading side surfaces 36 and 39 of the tool bit will be disposed 45° relative to the line of travel of the plate member.

Figure 7:
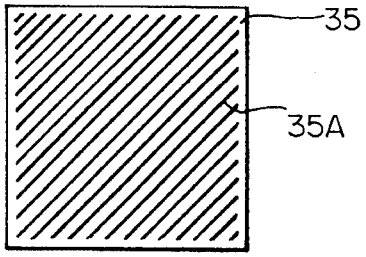
FIGS. 7, 8 and 9 illustrate embodiments of a material removal surface of the tool bit including cutting ridges, a rasp surface and cutting edges, respectively.
Figure 8:
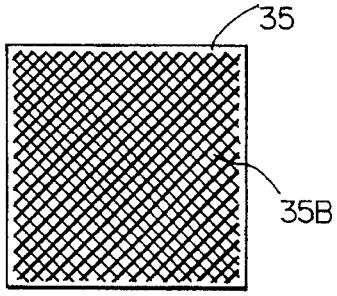
Figure 9:
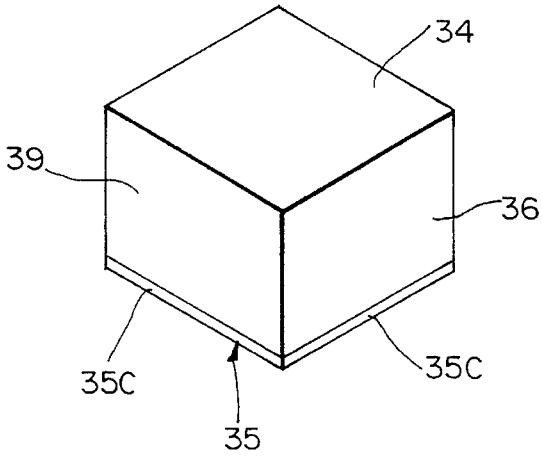

The bottom surface 35 of the tool bit is provided with a material removing texture. The surface may be abrasive, abraded or provided with cutting ridges 35A (FIG. 7) as in a file or rasp surface 35B (FIG. 8) or cutting edges 35C formed on the bottom wall of the tool bit (FIG. 9) so that as the tool bit is oscillated and lowered into a curved inside corner of a workpiece, the bottom surface will function to remove material from the workpiece.

Figure 6:
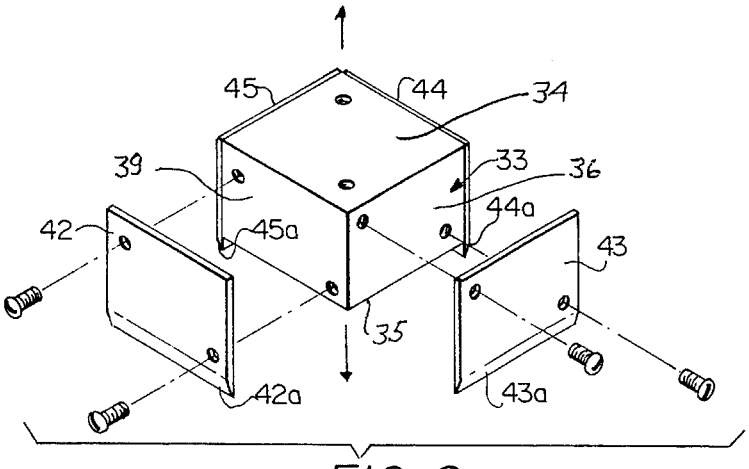
FIG. 6 is a perspective view of an alternate tool bit which can be used with the device shown in FIG. 4, illustrating components thereof in exploded relation.

Alternatively, as shown in FIG. 6, the material removal means of tool bit 33 may consist of a set of blades 42 through 45 which may be secured to the side surfaces of the tool bit and are provided with lower cutting edges 42*a* through 45*a* projecting below the bottom wall of the tool bit for engaging and cutting material of a workpiece.

Figure 3:
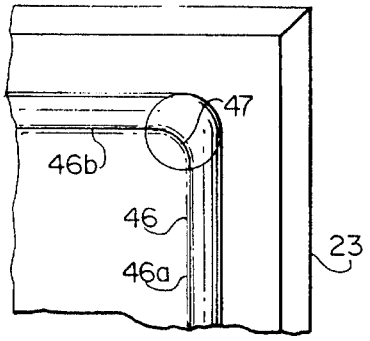
FIG. 3 is a fragmentary top view of a workpiece illustrating a groove having been routed therein which is adapted to be cut by the device shown in FIG. 2 to form a square corner.
Figure 5:
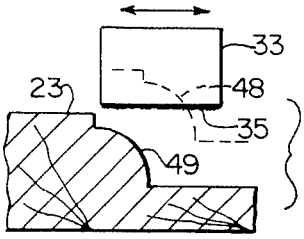
FIG. 5 is an enlarged cross sectional view taken along line 5—5 in FIG. 4, illustrating the tool bit of the device shown in FIG. 4 in relation to a workpiece.

In the use of the square corner forming device as described to manufacture a raised panel member of the type shown in FIG. 2, a router bit with a suitable configuration is mounted on tool head 22, the corner forming device is mounted on tool head 21, a workpiece is positioned on table 18 by pop up positioning pins or otherwise, the workpiece is held in the selected position by a vacuum system or otherwise and the machine is programmed to provide sequential routing and corner forming operations. When the workpiece is in position and the machine is started, the machine will operate to cause the router bit to form a groove having rectilinear portions 46*a* and 46*b* at right angles to provide a curved inside corner 47 as best shown in FIG. 3. When the routing operation is completed, the machine will position tool bit 33 sequentially in contact with each curved inside corner 47 with leading side surfaces 36 and 39 disposed parallel with groove sections 46*a* and 46*b*. With the tool bit oscillating at a high frequency along the line of travel as indicated by the arrows in FIGS. 4 and 5, the machine operates to move the apex of leading side surfaces 36 and 39 along a path as shown in FIG. 5 as at 48 to form a square corner in the curved inside corner having a profile as shown at 49 in FIG. 5. As the tool bit is fed into the workpiece corner, the bottom cutting surface of the tool bit will cut and remove material from the workpiece. The rapid oscillation of the work tool and the selected feed rate of the tool bit will provide a smooth, clean cut requiring no substantial force being applied by the tool head.

The machine may be programmed to provide whatever corner profile that may be desired. In addition to providing a corner forming tool bit having leading side walls disposed 90° apart, other angular displacements of such leading side walls can be used depending on the angle in the workpiece to be formed. In each such application, however, the angle between the leading side walls of the tool bit will be the same as the angle between adjoining sections of a groove providing a curved corner to be cut to permit the wall portions of the adjoining groove sections to meet in a line.

It has been found that a smooth cut not requiring excessive cutting forces can be achieved with an oscillation amplitude of the tool bit of 0.040 inches at a frequency of about 4,700 cycles per minute. Increased amplitudes in the range of 0.060 inches to 0.080 inches and frequencies in the range of 2,000 to 10,000 cycles per minute could be available.

The method as described for forming the grooves and cutting the corners on a workpiece can be accomplished on a machine with a single tool head by merely using the routing and corner forming tools sequentially, multiple tool heads as described or with a machine provided with a tool changer. The specific configuration of the corner forming tool bit will depend on the configuration of the groove in the workpiece. In any event, a single tool bit having a particular configuration may be used to provide multiple profiles by proper programming of the machine.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. A device mountable on a tool head of a machine having a rotatable spindle operable for forming a juncture of a pair of adjoining surfaces spaced a predetermined angle apart, in a curved portion of a workpiece, comprising:

support means mountable on said tool head;

a tool bit mounted on said support means for reciprocal motion along a line of travel, said tool bit having a pair of adjoining side wall surfaces each displaced at one angle equal to one-half of said predetermined angle, relative to said line of travel, and a bottom wall, provided with material removal means disposed on either lower edges of said side wall surfaces or said bottom wall; and means disposed in said support means for transmitting drive from said spindle to said tool bit including means for translating the rotary motion of said spindle to reciprocating motion of said tool bit along said line of travel;

whereby upon reciprocating said tool bit while guiding it along a predetermined path into a portion of said workpiece required to be removed to form said juncture, said material removal means will function to remove workpiece material to provide said juncture having a profile corresponding to the path along which said tool bit is guided.

2. A device according to claim 1 wherein said material removal means comprises a pair of cutting blades mounted on said side wall surfaces having lower cutting edges projecting below lower edges of said side wall surfaces.

3. A device according to claim 1 wherein said material removal means comprises an abrasive surface formed on said bottom wall of said tool bit.

4. A device according to claim 1 wherein said material removal means comprises cutting ridges formed on said bottom wall of said tool bit.

5. A device according to claim 1 wherein said material removal means comprises a rasp surface formed on said bottom wall of said tool bit.

6. A device according to claim 1 wherein said support means includes guide means disposed parallel to said line of travel and said tool bit includes means cooperating with said guide means to guide said tool bit along said line of travel.

7. A device according to claim 1 wherein said support means comprises a housing detachably mountable on said tool head, having a pair of opposed guide slots disposed parallel to said line of travel, including a plate member received within said guide slots and reciprocated therein along said line of travel and having a slot disposed transversely relative to said line of travel and said tool bit rigidly secured thereto, and wherein a lower end of said spindle is provided with an eccentrically disposed pin relative to the spindle axis, received within said transversely disposed slot in said plate member whereby upon rotation of said spindle, drive will be transmitted from said spindle to said plate member and tool bit and the rotary motion of said spindle will be translated to a reciprocating motion of said plate member and tool bit along said line of travel.

8. A device according to claim 7 wherein said tool bit is rigidly mounted on an underside of said reciprocal plate member.

9. A device according to claim 7 wherein said material removal means comprises a pair of cutting blades mounted on said side wall surfaces having lower cutting edges projecting below lower edges of said side wall surfaces.

10. A device according to claim 7 wherein said material removal means comprises an abrasive surface provided on said bottom wall of said tool bit.

11. A device according to claim 7 wherein said material removal means comprises cutting edges formed on said bottom wall of said tool bit.

12. A device mountable on a tool head of a machine having a rotatable spindle, operable for forming a square corner in a curved corner in a workpiece comprising:

support means mountable on said tool head;

a tool bit mounted on said support means for reciprocal motion along a line of travel, said tool bit having a pair of adjoining side wall surfaces each displaced 45° relative to said line of travel, and a bottom wall, provided with material removal means disposed on either lower edges of said side wall surfaces or said bottom wall; and means disposed in said support means for transmitting drive from said spindle to said tool bit including means for translating the rotary motion of said spindle to reciprocating motion of said tool bit along said line of travel;

whereby upon reciprocating said tool bit while guiding it along a predetermined path into the portion of said workpiece comprising said curved corner, said material removal means will function to remove material to provide a square corner of a desired profile.

13. A method of forming a juncture of a pair of adjoining surfaces spaced a predetermined angle apart in a curved portion of a workpiece, comprising:

positioning a tool bit having a pair of adjoining side wall surfaces displaced said predetermined angle apart with material removal means disposed on either the lower edges of said side wall surfaces or a bottom wall thereof adjacent the portion of said workpiece material forming said curved portion to be removed;

reciprocating said tool bit along a line of travel bisecting the planes of said side wall surfaces; and guiding the apex of said adjoining side wall surfaces of said tool bit along a predetermined path into said workpiece material to be removed to form a juncture having a profile corresponding to the path along which said tool bit is guided.

14. A method according to claim 13 wherein said tool bit is reciprocated at a frequency in the range of 4,700 cycles per minute.

15. A method according to claim 13 wherein the displacement amplitude of said tool bit is 0.040 inches.

16. A method of forming a juncture in a workpiece having at least two adjoining rectilinear sections angularly displaced relative to each other, comprising:

routing said sections to form a curved juncture between said adjoining sections;

positioning a tool bit having a pair of adjoining side wall surfaces spaced apart at an angle corresponding to the angular displacement of said sections relative to each other with material removal means disposed on either the lower edges of said side wall surfaces or a bottom wall thereof, adjacent said curved juncture of said workpiece;

reciprocating said tool bit along a line of travel bisecting the planes of said side wall surfaces; and guiding the apex of said adjoining side wall surfaces of said tool bit along a predetermined path into said workpiece behind said curved juncture to form a juncture having a profile corresponding to the path along which said tool bit is guided.

* * * * *